United States Patent [19]

Buswell

[11] 4,418,546

[45] Dec. 6, 1983

[54] CONTINUOUS TUBE REFRIGERATION SYSTEM

[76] Inventor: Harrie R. Buswell, 2646 Rhonda Ct., Duluth, Ga. 30136

[21] Appl. No.: 322,257

[22] Filed: Mar. 25, 1982

[51] Int. Cl.[3] ..... F25B 1/00

[52] U.S. Cl. ..... 62/115; 62/511

[58] Field of Search ..... 62/498, 511, 504, 527, 62/457, 115

[56] References Cited

U.S. PATENT DOCUMENTS 1,704,177 3/1929 Davenport ..... 62/511

4,150,558 4/1979 Pohl ..... 62/511 X

*Primary Examiner*—Lloyd L. King

*Attorney, Agent, or Firm*—James B. Middleton

[57] ABSTRACT

This invention relates to refrigeration means suitable for use in domestic refrigerators, freezers, dehumidifiers and small to medium air conditioners. It is also suitable for a variety of smaller size mechanical (vapor-compression) refrigeration functions found thoughout industry. The invention includes use of a continuous length of tubing thoughout the entire passage of refrigerant from the exhaust part of the compressor back to the intake part. The contiguous functions of condensation, accumulation, drier/filter, capillary action evaporation and heat exchange are all served by a one piece continuous length tubing formed, rolled and handled in necessary manner.

6 Claims, 16 Drawing Figures

FIG. 1
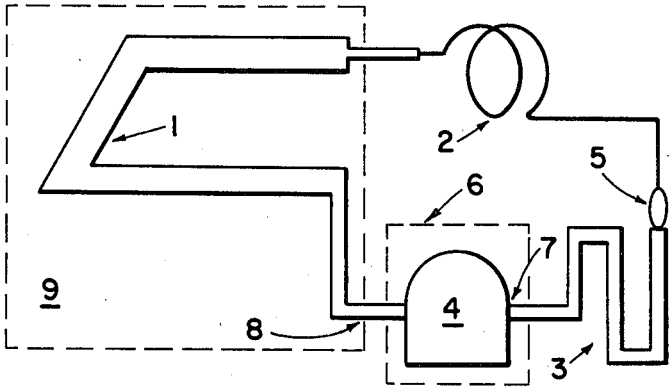
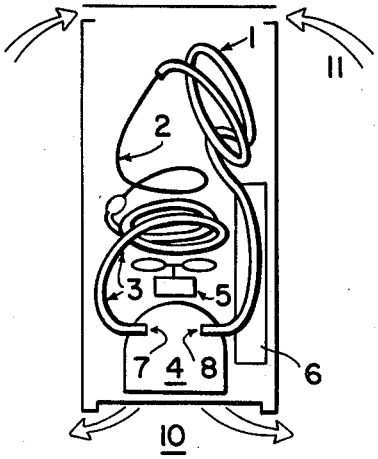
FIG. 2A
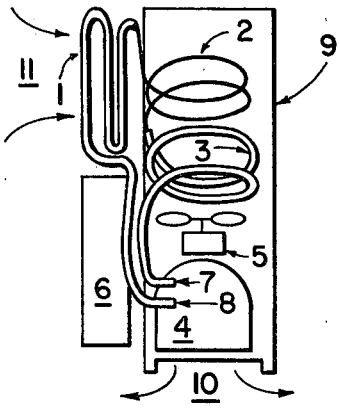
FIG. 2B

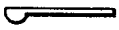
FIG. 3
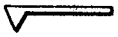
FIG. 4A
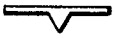
FIG. 4B
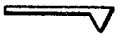
FIG. 4C
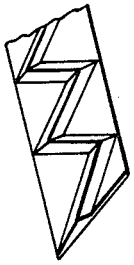
FIG. 5A
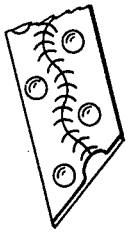
FIG. 5B
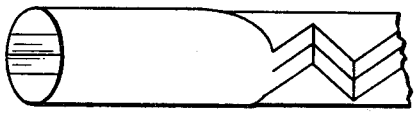
FIG. 6
FIG. 7
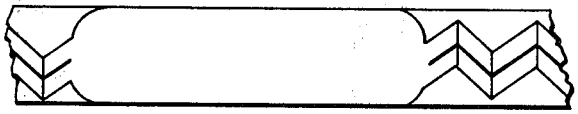
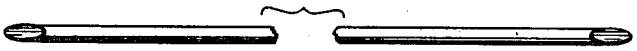
FIG. 8
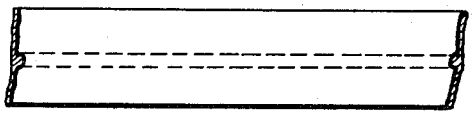
FIG. 9

CONTINUOUS TUBE REFRIGERATION SYSTEM

SUMMARY OF THE INVENTION

This invention can be applied to domestic refrigerators, freezers, dehumidifiers and small to medium air-conditioners. It is also suitable for a variety of smaller size mechanical refrigeration functions enjoying wide and diverse use in industrial applications. The invention represents an improvement of technique as well as kind of systems offering a small advantage in economy of use and significant advantage in the decreased cost of materials, fewer construction steps and less time spent in production.

The system embodies the use of a continuous length of tubing formed to produce the various desirable functions in contiguous fashion necessary to the operation of a vapor compression system. The various functions include contiguous connection to the compressor, condenser, accumulator, drier/filter, capillary (restrictive device), evaporator, heat exchanger and finally reconnection to the compressor inlet port. Each major functional area requires different actions and thus is conventionally a different section joined together with the others. This process is one of forming, rolling and otherwise forcing into shape a tubing to meet the demands of each function. It is by the use of a suitably sized tubing much larger in diameter than conventional systems of similar capacity that this is accomplished.

HISTORY OF THE INVENTION

Since the inception of mechanical refrigeration some sixty years ago it has proven to be an efficient means of removing heat from an area. It has been so effective that improvements to the system have been only slight and indeed it is a question whether many changes were in fact overall improvements. Frigidaire, for example, introduced a rotary compressor equipped refrigeration device before 1935 which also utilized a capillary tube restrictive device. Today's refrigerator hundreds of patents and almost fifty years later must strain to boast saving more energy—or be quieter or longer lasting than that particular machine! The inception of capillary tube design restrictive means represented a major change and improvement in the system—it was in fact a simplification of construction of refrigeration units and has been applied successfully to domestic refrigerators, freezers, dehumidifiers and air conditioners of small to medium size.

Manufacturing techniques have been streamlined, case construction has changed in revolutionary fashion but nearly the same processes and steps are used in construction of dehumidifiers, refrigerators freezers as regards their refrigerative components. This invention deals with construction technique as well as design of the refrigerative system, indeed in this particular case the two enjoy an inseparable relationship. This invention does recognize our technological advancements and whereas it might have been a difficult process and approach in 1930, it is indeed a significant change and improvement in the 1980s. Additionally and significantly the stress upon saving energy in present times also weights the advantages and disadvantages in a different manner than in the past.

BACKGROUND OF THE INVENTION

Refrigeration techniques have remained very stable over the last forty years. Two systems have been in common use; the absorption system which utilizes low grade energy input and the mechanical system that utilizes a compressor for energy input. New types include more direct systems that accept electricity or sunlight as the energy source. These approaches, although high technology, will produce systems simpler in parts than we now have.

The system herein described is a simplification of the present mechanical system. It is a simplification that allows a realization of savings during manufacture and a slight but significant savings during operation. Decreased cost of materials and fewer construction steps are necessary. This is in itself noteworthy since the above two points allow a significant cost reduction. But the completed product, in use, represents savings as well due to a slightly more efficient nature. A savings of 5–8% in production costs is significant when counted in thousands of units produced. Likewise a savings of 1–2% in operation is significant in perspective of thousands of hours of operation. Both production savings and operational savings realized with this invention represent ultimately the saving of precious energy resources. The system utilizes a one piece construction of what formerly was four or more pieces. One piece of tubing is used for the entire evaporator, condenser, restriction (capillary) and drier/filter/accumulator. This piece also becomes the sole heat conducting element of the evaporator and condenser A large (relatively) diameter tubing-aluminum, copper, etc. is worked down to proper inside dimensions using conventional rolling, forming and working techniques. Concommitant to the diameter forming process, the assembly is formed and shaped into its final use configuration. For example; a serpentine shaped condenser section, a folded capillary section and a tiered evaporator section. The use of drier/filter can be accomplished by inserting dessicant into the tubing to the proper position prior to or during the forming operation. The capillary section can be handled in two ways. One is a (copper or aluminum) capillary tube may be inserted into the tubing adjacent to the drier/filter prior to the forming operation which then becomes a part of the assembly in the forming function. The second is the restrictive section may be formed, by forming a capillary from the tubing while in the forming process. The integrity of the capillary restrictive ability can be further assured by external clamping.

A preferred embodiment for domestic freezer use is a serpentine shape for the condenser and a tiered shape for the evaporator. This scheme allows a minimum of space usage away from the outside of the cabinet by the condenser and allows a minimum of lost space in the interior by the evaporator. The tiered effect contributes to an overall of cooling and may be formed in such manner as to allow shelves to rest on the tiers. The tiers have thus become shelf supports. This scheme also tends to place the cooling coils close but not touching the product—an optimum condition of freezer application.

One preferred embodiment for dehumidifiers is a circular spiraling arrangement which places all elements adjacent to and above the compressor. This scheme is an easy-to-manufacture approach and utilizes space well. A fan can be conveniently mounted on the inside of this spiral to force air across all coils.

A preferred embodiment for air conditioners is similar to the aforegoing. Two spirals of coil, except now they must be separated. Upright freezers and refrigerators can benefit by incorporation of the evaporative coils being a part of the shelving system. The use of this system in refrigerators and freezers also suggests that the refrigeration unit will be handled as a system to be installed in toto in a cabinet at one time. This has been done in the past and necessitates access doors or covers large enough to withdraw entire evaporator sections. There is some economy in this approach in that service on the refrigeration system both during and after warranty periods is much facilitated. Along the same line is the further realization of economy in that since fewer steps and connections are necessary in manufacture; then fewer problems of quality control types and repairs are necessary.

This design also lends itself to application to frost free type refrigerators. The evaporator can be formed into a suitably shaped configuration so as to satisfy moving air needs. The forming of said evaporator can accommodate a defrost device such as electrical heater with a minimum of time and parts to attach said heater. In such configuration and application this invention offers considerable savings in construction time. The greatest disadvantage of the system is that being a one piece construction a large plate cover type opening need be constructed in the cabinet to access the evaporator section. One further advantage of this system can help to offset that disadvantage in the consideration of problems encountered the system can be removed from the cabinet to be replaced by another. This allows on-the-spot repair (via replacement) of defective systems by lesser skilled individuals thus realizing a savings in space, lost time and skill level. Further advantage of this process is that sections even though continuous can be segmented to meet the need of the application. One noteworthy example is when the evaporator section is utilized in a freezer to form shelf supports. The evaporator section can be flattened for shelf support then not flattened in the section rising up to another shelf area.

THE DRAWINGS

FIG. 1 is a representative drawing of a complete refrigerative system embodying this invention in the form as used in domestic freezer use.

FIGS. 2A and 2B are representative embodiments of the system in dehumidifier application. FIG. 2A illustrates evaporator section included within the case whereas FIG. 2B illustrates the evaporator section and consequent drain tub exterior to the case.

FIG. 3 illustrates constriction of inside volume by flattening forming of the tubing.

FIGS. 4 A,B, and C are cross sections of the tubing at different points along the condenser section which illustrate the pathway within the tubing at those various points.

FIGS. 5 A and B illustrates two of the many shapes possible to restrict inside volume of the tubing condenser section.

FIG. 6 illustrates the end area of the condenser section which is ready to accept insertion of the dessicant.

FIG. 7 illustrates the continuance of the tubing with unformed area left occupied by the dessicant bag.

FIG. 8 is a drawing of the capillary tubing with both ends beveled in preparation for insertion into the tubing.

FIG. 9 is a drawing of the capillary installed in the tubing and the assembly formed into an integral unit with only space provided inside the capillary tube.

Figure 10:
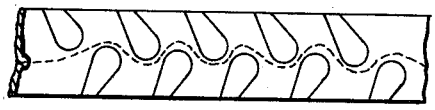

FIG. 10 illustrates one of several possible ways to handle the forming of the evaporator section.

Figure 11:
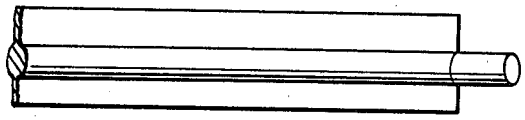

FIG. 11 illustrates the final section connected to tubing such as projects from the compressor.

Figure 12:
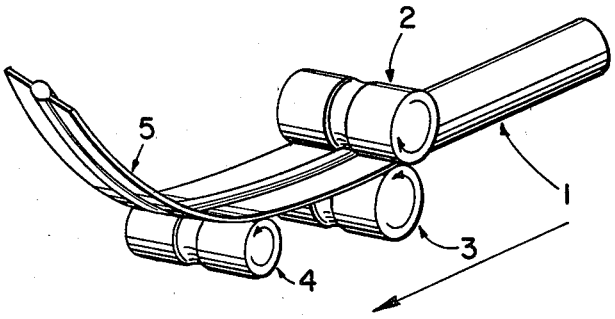

FIG. 12 illustrates the forming (lengthwise) and the shaping (crosswise) of the tubing in most basic form.

DETAILED DESCRIPTION OF THE INVENTION

This description will endeavor to describe and illustrate the system construction as well as final form and function. There being several logical forms this invention can take, this description centers about the preferred embodiment in a dehumidifier application.

Figure One is an embodiment of this invention as applied to a domestic freezer. The various components of the system are numbered for identification. Item 1 is the section of formed evaporator coil. In this embodiment said evaporator is formed into a flattened profile to serve as shelf support as well as provide cooling. Item 2 is the capillary section, item 3 is the condenser section, item 4 is the compressor and item 5 is the drier/filter-accumulator. Item 7 is the exhaust port of the compressor, item 8 is the intake port. Item 9 is the representation of the cooling cabinet while item 6 represents the compressor section or alcove of the cabinet.

Drawings labeled FIGS. 2A and 2B are alternate embodiments of this system applied to dehumidifier use. The various pieces in both embodiments are numbered as follows: Item 1 is evaporator which in FIG. 2A is included inside the case while in FIG. 2B it is exterior to the case. Item 2 is the capillary section. Item 3 is the condenser section. Item 4 is the compressor. Item 5 is the air moving fan assembly. Item 6 is the water tank which is included within said case in FIG. 2A embodiment and exterior to the said case in FIG. 2B embodiment. Item 7 in FIGS. 2A and 2B is the exhaust port and item 8 is the intake or suction port. Item 9 represents the said case in both embodiments. Items 10 and 11 indicate preferred direction of air flow paths.

The beginning component of the system is a (relatively) large diameter tubing. This said embodiment employs a 2" diameter sixteen foot long aluminum tubing with a wall thickness of 1/32". FIG. 12 illustrates the forming/shaping process. Item one of FIG. 12 is the tubing before the process begins. Item two is the upper shaping roller. Item three is the lower shaping roller. These said two rollers operate in conjunction to shape the tubing. Item four is the forming roll which is placed in proper position to "curl" the shaped tubing. Item five is the end result; fully shaped and formed tubing. Different functional sections will have different shaping and forming rolls. Step one consists of forming the section connecting to the exhaust port of the compressor and leading to the condenser section. The said operation is accomplished by a forming guide in a proximal relationship to shaping rolls to provide form (lengthwise) bending consecutively with shaping (diameter) bending. The shape of this said section is a simple reduction of inside volume and diameter—FIG. 3. Rollers squeeze the large circular shape down to a small circular shape with excess material spread flat on the sides. The form is also simple with only a minor reforming necessary to route the tubing from exhaust port to the beginning of condenser section. Note that the forming guide FIG. 12, bends the tubing lengthwise and that it is in a proximal relationship to the rolling operation which serves to hold the tubing as it is formed into a helical shape suitable for this said dehumidifier application.

The next process step in the said embodiment involves continuing the helical forming of said tubing but with a change in rolling operation. Roller operation now shapes the tubing in an alternating pattern to provide an elongated refrigerant pathway through the tubing and increased contact of refrigerant with tubing walls thereby forming an effective heat exchange to the exterior—FIG. 5. Several forms—fluting, dimpling, rolling and bubbling forms are feasible—FIG. 4. In turn the said condenser enjoys good communication with the ambient environment surrounding it due to the greatly increased surface area relative to inside volume. Following formation of the said condenser section is that of accumulator, drier/filter. A dessicant bag is inserted into the unformed open end of said tubing and sent into position against the conformation of the said condenser section internal conclusion. Insertion of said dessicant bag can be accomplished in several ways; thrust in by a long rod, pulled in by a string, or as in this case it is forced in by dry gas with sufficient pressure behind it and a slight vacuum ahead of it. The tubing is not reduced in size for this portion of the system. The said dessicant bag should be sized to nicely fit into the tubing, thus filling that area of the unformed said tubing—FIG. 6. Then the bag is sealed in by continuation of the next step—FIG. 7. The next process step of the said embodiment involves insertion of the capillary tube into the tubing until it reaches the convoluting restriction at the end brought about by the said enclosing (FIG. 7) of the filter/drier dessicant bag. So as not to be unduly restricted by butt action against inside walls and to be insured of proper capillary action restrictive flow, the said capillary tube should be beveled at both ends—FIG. 8. There is then no placement which will shut off the capillary tube when said bevel is incorporated. A simple closure technique is now used to press the metal (or material) down closely around the said capillary tube. No other pathway can be permitted the refrigerant other than through said capillary. The resulting shape of the tubing and capillary is illustrated in FIG. 9. The continuance of the helical spiral provides position for the capillary tubing to occupy in the said dehumidifier structure spiral capillary section into an overlay adjacent to the said condenser section. The ending of said capillary section is the beginning of the convolutions of said evaporator section. This insures that the said capillary tube can not shift its lengthwise position.

The said evaporator section is formed and rolled in similar fashion to the condenser section in this embodiment of said dehumidifier—FIG. 10. The final section is suction/return line which is shaped down to necessary internal volume and formed to pass back adjacent to the capillary section to be connected to it to provide heat exchange capability thus facilitating refrigerative action and protecting the compressor from flooding of liquid refrigerant—FIG. 10. Satisfactory thermal communication may be accomplished by curling a part of the flattened said capillary section around the return line. Another approach is to form a "hook" into one edge of said capillary and a similar "hook" into an edge of the suction/return line in order that the two may be thus joined.

While I have endeavored to teach the concepts and techniques embodied in this application particularly within the sections of history, background details, and summary, it will be appreciated that numerous modifications and embodiments may be and will be devised in the construction of refrigerative systems utilizing this invention by those skilled in the art. It is intended that the two major claims and subsequent minor claims cover such modifications and embodiments as fall within the scope and spirit of this invention. Further, it is understood that the said teaching efforts are in support of these said following claims.

What I claim is:

1. A method for providing the refrigerant path in a refrigeration system, said refrigeration system comprising a compressor, said compressor having an output port, a condenser arranged for receiving refrigerant from said output port and dissipating heat from said refrigerant, restriction means arranged for receiving refrigerant from said condenser, an evaporator arranged for receiving refrigerant from said restriction means and allowing said refrigerant to expand and absorb heat, said compressor having an input port for receiving refrigerant from said evaporator, said method including the steps of providing a single, integral length of tubing having a given diameter, forming a first portion of said length of tubing to provide a fluid passageway therethrough of less than said given diameter and having fins extending from said fluid passageway for providing said condenser, forming a second portion of said length of tubing to provide a capillary tubing for providing said restriction means, said first portion and said second portion being in communication through said length of tubing, forming a third portion of said length of tubing for providing a fluid passageway therethrough of less than said given diameter and having flattened portions extending therefrom for providing said evaporator, said second portion and said third portion being in communication through said length of tubing, connecting one end of said length of tubing to said output port of said compressor, and connecting the other end of said length of tubing to said input port of said compressor, so that said refrigerant path is provided by said single, integral length of tubing.

2. A method as claimed in claim 1, and further including the step of inserting a small diameter tubing into said length of tubing, placing said small diameter tubing at said second portion of said length of tubing before the step of forming a second portion of said length of tubing, and carrying out the step of forming said second portion of said length of tubing so that said small diameter tubing forms said capillary, said length of tubing being so formed as to require that refrigerant pass through said small diameter tubing.

3. A method as claimed in claim 2, and further including the step of cutting both ends of said small diameter tubing at an angle before the step of inserting a small diameter tubing.

4. A method as claimed in claim 1, said refrigeration system further including an accumulator between said condenser and said restriction means, said accumulator being provided by maintaining said length of tubing at said given diameter for the length of said accumulator.

5. A method as claimed in claim 4, and further including the step of placing a filter into said accumulator prior to forming a subsequent portion of said length of tubing.

6. A method as claimed in claim 5, said step of forming a first portion of said length of tubing including the steps of flattening said length of tubing to provide a non-linear fluid passageway for yielding a fluid passageway having a greater length than the length of said first portion of said length of tubing.

* * * * *